United States Patent [19]

Gulliksson

[11] 4,181,291

[45] Jan. 1, 1980

[54] APPARATUS FOR SUPPORTING AND CONTROLLING THE GRABBING DEVICE OF HOISTING GEAR

[75] Inventor: Sture G. Gulliksson, Ornskoldsvik, Sweden

[73] Assignee: Aktiebolaget Hagglund & Soner, Ornskoldsvik, Sweden

[21] Appl. No.: 835,027

[22] Filed: Sep. 20, 1977

[30] Foreign Application Priority Data

Oct. 13, 1976 [SE] Sweden ..... 76113307

[51] Int. Cl.[2] ..... B66D 1/26

[52] U.S. Cl. ..... 254/184; 37/184; 414/624

[58] Field of Search ..... 254/184, 185 R, 144, 254/145; 214/656, 657; 37/184, 115, 185

[56] References Cited

U.S. PATENT DOCUMENTS

| | | | |
|---|---|---|---|
| 1,000,677 | 8/1911 | Hayward | 214/656 |
| 1,058,539 | 4/1913 | Botten | 37/184 |
| 1,401,951 | 1/1922 | Armstrong | 214/656 |
| 1,441,023 | 1/1923 | Poland et al. | 37/184 |
| 1,914,613 | 6/1933 | Neffendert et al. | 37/184 |
| 2,808,166 | 10/1957 | Stine | 37/184 |
| 3,523,614 | 8/1970 | Walker | 37/184 |

FOREIGN PATENT DOCUMENTS

| | | | |
|---|---|---|---|
| 956477 | 6/1956 | Fed. Rep. of Germany | 214/656 |

*Primary Examiner*—Robert J. Spar
*Assistant Examiner*—Kenneth Noland
*Attorney, Agent, or Firm*—Cushman, Darby & Cushman

[57] ABSTRACT

The one ends of the closing rope and holding rope of the jib or other hoisting gear-suspended grab of a winch are wrapped about a common drum and travel equivalent paths for syncronization of rope movement as the grab is raised and lowered. The opposite end of the closing rope is wrapped about an auxiliary drum or other extensible, retractible load rope anchoring device, equipped to be rotated, on command by an amount sufficient to open or close the grab.

10 Claims, 9 Drawing Figures

APPARATUS FOR SUPPORTING AND CONTROLLING THE GRABBING DEVICE OF HOISTING GEAR

FIELD OF THE INVENTION

The present invention is concerned with a method and device for use with hoisting gear, e.g., a deck crane, for the rope-driven opening and closing of grabbing gear for loads.

BACKGROUND OF THE INVENTION

According to known practice, certain grabbing devices, e.g., one design of grab, are supported and also opened and closed by ropes attached to a load winch in the hoisting gear. In this arrangement, the load winch has two drums that are synchronized via a gear unit and coupled to a driving motor. One of the drums carries the closing rope, for opening and closing the grab, and is always connected to the driving motor, while the other drum, which carries the holding rope for the grab, can be disengaged by means of a disc clutch and brake provided in the gear unit. By this means the grab can be stopped in its downward motion, whereby the opening and closing functions are obtained by slackening or tensioning the closing rope.

The disadvantages of this construction are that the design is complicated, expensive, and bulky, and results in high costs for transportation, erection, inspection and maintenance.

Other designs are also known in which the grabbing gear, the grabs, are provided with electrical or hydraulic opening and closing equipment.

These embodiments involve such disadvantages as complicated power supply, heavier grabs, heavy electrical cables between the hoisting gear and the grab, and high costs for erection, transportation, inspection and maintenance.

SUMMARY OF THE INVENTION

The present invention provides a device based on a grabbing device, e.g., a grab, rope-driven in its simplest form, incorporating a simpler solution of the rope arrangement and other associated problems, and with the above-mentioned drawbacks eliminated; to achieve a design which is simple, inexpensive, and adapted to its purpose; and to reduce inspection and maintenance to a minimum.

The one ends of the closing rope and holding rope of the jib-suspended grab of a winch are wrapped about a common drum and travel equivalent paths for syncronization of rope movement as the grab is raised and lowered. The opposite end of the closing rope is wrapped about an auxiliary drum, equipped to be rotated, on command by an amount sufficient to open or close the grab.

In the following paragraphs the invention will be described with reference to the attached drawings, showing an embodiment of a hoisting equipment in the form of a slewing crane with grabbing gear consisting of a rope-driven grab.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PRESENTLY PREFERRED EMBODIMENTS

Figure 1:
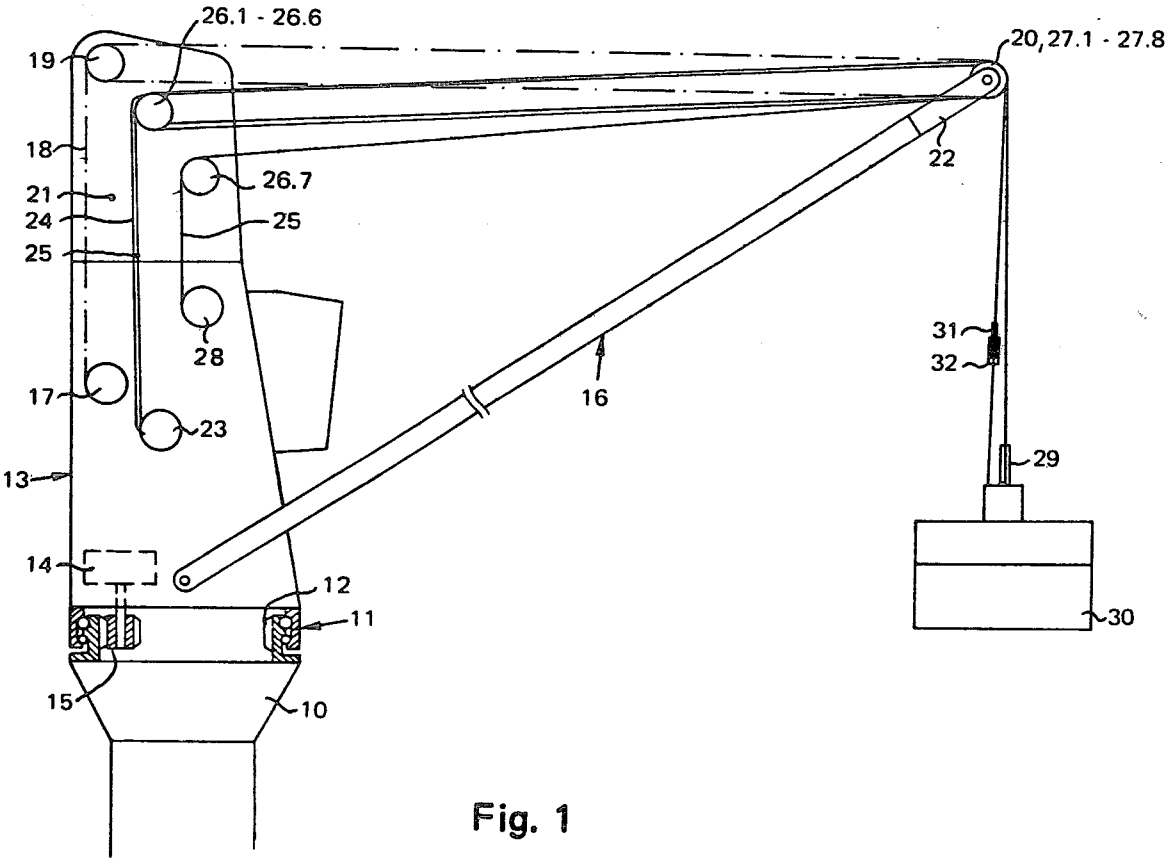
FIG. 1 shows a partial front elevation of a hoisting equipment with the grabbing gear of the invention.

In FIG. 1, a crane base 10, mounted on the hull of a ship (not shown), carries via a slewing rim 11 with a gear ring 12 a hoisting equipment in the form of a revolving luffing crane generally denoted as 13.

The crane 13 includes a slewing machinery 14 with a drive 15 that engages with the gear ring 12, a luffing jib 16, luffing machinery 17, luffing rope 18, luffing rope pulleys 19 and 20 at the top 21 of the crane structure and at the head 22 of the jib, a hoisting mechanism generally denoted as 23 with load ropes of which one is referred to as the holding rope 24 and the other as the closing rope 25, load-rope pulleys 26.1–26.7 and 27.1–27.8 located at the top 21 of the crane house and the head 22 of the jib. The crane 13 also includes a control winch, denoted generally as 28, to which the closing rope 25 is attached.

Figure 2:
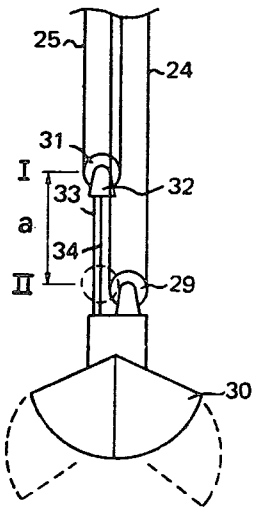
FIG. 2 shows a side elevation including part of the rope arrangement of the grabbing gear of FIG. 1.

FIG. 2 shows the manner in which the holding rope 24 is passed around a pulley-block 29 that is attached to a rope-driven grab 30, while the closing rope 25 passes round a pulley-block 31 (see also FIGS. 3 and 4) having a yoke 32 to which are attached two hauling ropes 33 and 34 forming part of the grab 30 and used for opening and closing the grab 30, the pulley-block 31 being in position I when the grab 30 is closed and in position II when the grab is open (dashed lines). The hauling ropes 33 and 34 that form part of the grab 30 pass over pulleys 35.1, 36.1 and 35.2, 36.2 respectively, to fixed points 37 and 38, the pulleys 36.1 and 36.2 being lowered when opening the grab and raised when closing the grab 39.

Figure 5:
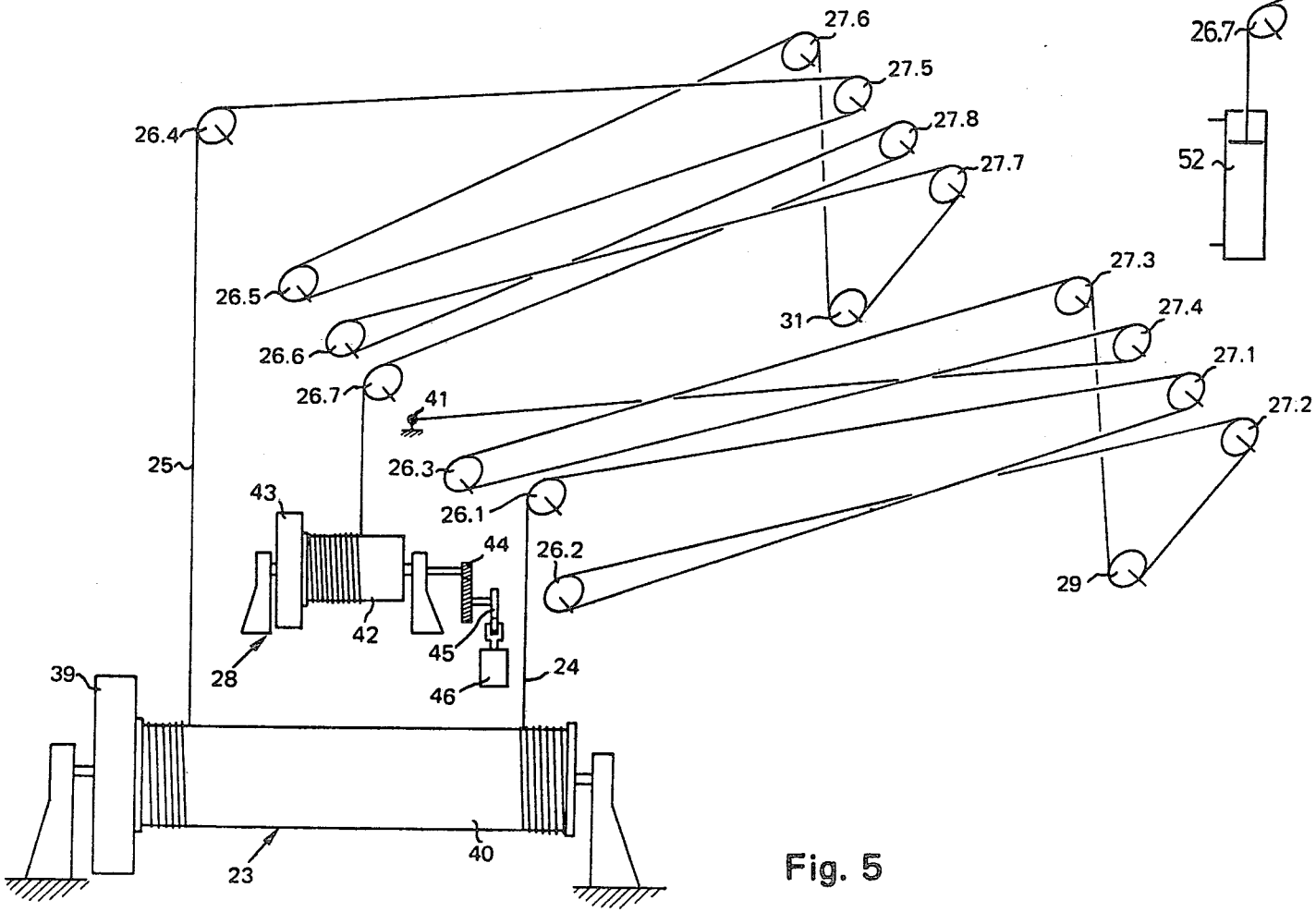
FIG. 5 shows schematically the rigging of the ropes between the hoisting gear and the grabbing gear of FIG. 1.

FIG. 5 shows in a more schematic fashion the arrangement of the holding rope 24 and the closing rope 25. The hoisting machinery 23 includes a driving motor 39 with a load-rope drum 40 that can be used to wind and unwind both the holding rope 24 and the closing rope 25, whereby both ropes are enabled to travel at the same speed. The holding rope 24 runs from the load-rope drum 40 over the pulleys 26.1–27.1–26.2–27.2, down to the pulley-block 29, and then over pulleys 27.3–26.3–27.4 to a rope clamp 41 shown schematically as a point located next to pulley 26.7. The closing rope 25 runs from the load-rope drum 40 over pulleys 26.4–27.5–26.5–27.6, down to the pulley-block 31 on the grab, and then over pulleys 27.7–26.6–27.8–26.7 to the auxiliary rope drum 42 of the control winch 28, which drum is driven by a motor 43. The pulleys 26. . are located at the top 21 of the crane structure and the pulleys 27. . at the head 22 of the jib. Inasmuch as the said control winch 28 is incorporated in the rigging, the opening and closing of the grab 30 becomes very simple. When closing the grab 30, a length equivalent to two times distance a in length (see FIG. 2) of the closing line 25 is wound onto the control winch 28, and conversely is wound off when opening the grab 30.

The number of revolutions performed by the control winch 28 for the necessary opening and closing of the grab 30 is limited by means of a gear 44 having a cam disc 45 and limit switch 46, which are connected to the control winch. This enables the crane operator to open or close the grab 30 via a control pulse by any conventional signalling means (not shown) to the control winch 28 without any need to consider whether the correct length of rope has been paid out or wound in. Thanks to the fact that only one load-rope drum 40 is used, and to the rigging, synchronized movement is automatically achieved between the holding rope 24 and the closing rope 25, and between the pulley blocks 29 and 31, as the filled or emptied grab 30 is raised or lowered. The holding rope 24 acts as holding and supporting rope for the grab 30, and the closing rope 25 acts as supporting rope and closing rope for opening and closing the grab 30. Thanks to the geometric arrangement of the crane-ropes being identical in the pulley set 26. . at the top 21 of the crane house and in the pulley set 27. . at the head 22 of the jib, the grab 30 is kept closed or open in any vertical position of the grab 30 and at any slope of the jib 16.

The grab 30 can be opened or closed at the same time as the load is being raised or lowered and at the same time as the jib 16 is being luffed outwards or inwards, a capability which especially facilitates the filling of the grab 30. This gives the benefit of high loading and unloading capacity.

If the crane 13 is to be used for normal piece-goods handling instead of grab operation, this is very simply achieved by coupling together blocks 29 and 31, so that the control winch 28 need not be used.

Figure 6:
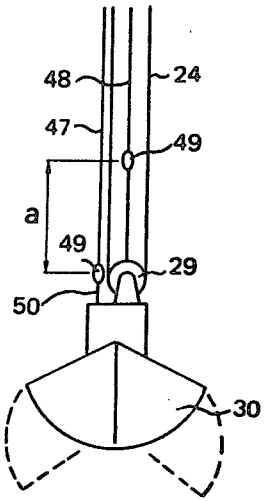
FIG. 6 is a first variant of the apparatus shown in FIG. 2, showing the arrangement of the ropes of the grabbing gear.
Figure 7:
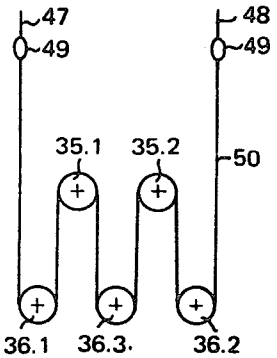
FIG. 7 shows schematically the arrangement of the closing rope in the grabbing gear of FIG. 6.
Figure 3:
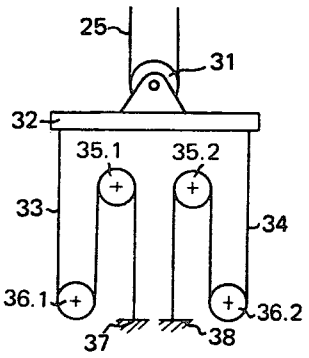
FIG. 3 shows schematically the arrangement of the closing rope of the grabbing gear of FIGS. 1 and 2.
Figure 4:
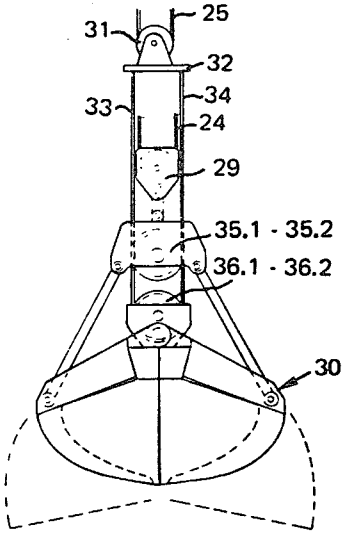
FIG. 4 shows the grabbing gear of FIGS. 1 and 2 in more detail and on a larger scale.

FIGS. 6 and 7 show in schematic form a first variant of the arrangement of ropes to the grab 30, whereby the closing rope is divided into two closing strands 47 and 48, which are connected via bulbs 49 to the hauling rope 50 of the grab, the hauling rope being in this case a single rope passing over all the pulleys 35. . and 36. . , with an extra pulley 36.3 added to obtain equivalent traction characteristics. The said rope arrangement enables the grab 30 to be raised higher up towards the head 22 of the jib, since the space for the pulley-block 31 mentioned in connection with FIGS. 2, 3, and 4 is eliminated.

In this case, too, the crane 13 is easily set up for piece-goods handling, since all that is necessary is to bring together the strands 47 and 48, attach the pulley-block 31 and couple the latter to the pulley-block 29.

Figure 8:
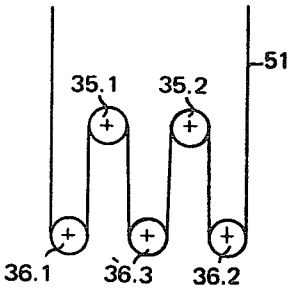
FIG. 8 shows schematically a second variant of FIGS. 3 and 7, showing the arrangement of the closing rope to and of the grabbing gear.

FIG. 8 shows schematically a second variant of the closing rope arrangement. This closing rope 51 consists of a single length common to the crane rigging and the grab 30. The ordinary grab hauling-rope can thus be omitted. With this arrangement, the grab 30 can be raised up even closer to the head 22 of the jib than is shown in earlier figures. In this case, too, the crane 13 can be set up for piece-goods handling, since it is possible to remove the closing rope 51 from the grab, attach a pulley-block 31 and couple the latter to pulley-block 29.

Figure 9:
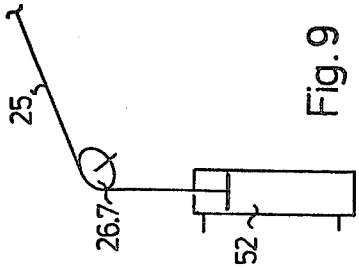
FIG. 9 shows a fragment of the apparatus of FIG. 5, in a variant wherein the auxiliary rope drum is replaced by a hydraulic cylinder.

Instead of a control winch 28, a hydraulic cylinder 52 may be used, with the traction length geared up or down to length equivalent to two times distance a, if necessary by a block arrangement. See FIG. 9.

The described embodiment and variants refer to the case with one holding rope and one closing rope, but there is nothing to prevent the use of more than one rope if a set-up for heavier loads is desired, or if such is appropriate in view of the rope size. In the case (not shown) of double holding ropes and double closing ropes, for example, the rope arrangement of FIG. 5 may be doubled, i.e., with two holding ropes 24 and two closing ropes 25 on the load-rope drum 40, and with the ends of the two closing ropes wound on auxiliary rope drum 42. There will also be twice the number of pulleys 26. . and 27. . , and double pulley-blocks 29 and 31 respectively.

The described embodiment and variants may be modified in detail within the terms of the Claims, and are also apt, as far as applicable, for other types of hoisting gear than cranes and for other types of grabbing gear than grabs, even if this is not specially stated. Thus, for example, the principle of the rope arrangement can also be used for bridge cranes having a traveling trolley, where the holding rope is used for raising and lowering and grabbing gear and the closing rope for opening and closing the grabbing gear. As a further example, the grabbing gear may be in the form of a transporting device for unit loads, with its closing and opening functions designed as in the case of a grab.

It should now be apparent that the apparatus for supporting and controlling the grabbing device of hoisting gear as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. Apparatus for supporting and controlling an openable-closable grabbing device of hoisting gear which includes a load winch drum, said apparatus comprising:

an extensible, retractible load rope anchoring device;

first and second supports for the openable-closable grabbing device;

a first load rope wrapped at one end around the load winch drum, and being rigged, then around said first support for the openable-closable grabbing device, and at the opposite end thereof to said extensible-retractible anchoring device;

a second load rope wrapped at one end around the load winch drum, and being rigged, then around said second support for the openable-closable grabbing device, and to a fixable anchoring device;

means for extending and retracting the extensible-retractible anchoring device by a selected amount for opening and closing the grabbing device, whereby the grabbing device is supported by both the first and second load ropes, and both load ropes are taken up and paid out in a synchronized manner as the load winch drum is operated, and the grabbing device is opened and closed by effectively lengthening and shortening the amount of the first load rope in use relative to the amount of the second load rope in use by operating said means for extending and retracting said extensible-retractible anchoring device;

the first support for the openable-closable grabbing device comprising:

a pulley block having said first load rope entrained thereabout;

a yoke suspended from said pulley block;

at least one pair of pulleys mounted with respect to said grabbing device where one pulley of each of said at least one pair of pulleys moves toward and away from the other pulley of each of said at least one pair of pulleys for opening and closing said grabbing device; and a hauling rope connected at one end to said yoke, and at the opposite end to a fixed point relative to said grabbing device, and being entrained about each of the pulleys of said at least one pair of the pulleys, whereby:

shortening and lengthening of the relative amount of said first load rope in use by operating said means for extending and retracting said extensible-retractible anchoring device, withdraws and advances said yoke relative to said fixed point and moves said one pulley of each of said at least one pair of pulleys toward and away from the other pulley of each of said at least one pair of pulleys, thus opening and closing the grabbing device.

2. The apparatus of claim 1, wherein:

said second support for the openable-closable grabbing device comprises:

a pulley block mounted on the openable-closable grabbing device, including a pulley having said second load rope entrained thereabout.

3. The apparatus of claim 1, wherein:

the extensible-retractible rope anchoring device is constituted by an auxiliary rope drum about which the opposite end of said first load rope is wrapped.

4. The apparatus of claim 1, wherein:

the extensible-retractible load rope anchoring device is constituted by a hydraulic cylinder and piston set having an anchored end, and an extensible-retractible end to which said opposite end of the first load rope is secured.

5. Apparatus for supporting and controlling an openable-closable grabbing device of hoisting gear which includes a load winch drum, said apparatus comprising:

an extensible, retractable load rope anchoring device;

first and second supports for the openable-closable grabbing device having at least one pair of pulleys;

a first load rope wrapped at one end around the load winch drum, and being rigged, then around said first support for the openable-closable grabbing device, and at the opposite end thereof to said extensible-retractible anchoring device;

a second load rope wrapped at one end around the load winch drum, and being rigged, then around said second support for the openable-closable grabbing device, and to a fixable anchoring device;

means for extending and retracting the extensible-retractible anchoring device by a selected amount for opening and closing the grabbing device, whereby the grabbing device is supported by both the first and second load ropes, and both load ropes are taken up and paid out in a synchronized manner as the load winch drum is operated, and the grabbing device is opened and closed by effectively lengthening and shortening the amount of the first load rope in use relative to the amount of the second load rope in use by operating said means for extending and retracting said extensible-retractible anchoring device and which also causes one pulley of each of said at least one pair of pulleys to move toward or away from the other pulley of each of said at least one pair of pulleys to also cause the opening and closing of the grabbing device;

the extensible-retractible rope anchoring device being constituted by an auxiliary rope drum about which the opposite end of said first load rope is wrapped;

the auxiliary rope drum being powered by means including:

means for rotating the auxiliary rope drum by an amount and in a direction just sufficient to open or close the grabbing means upon receipt of a command; and means for receiving such command.

6. The apparatus of claim 5, wherein:

the rotating means comprises a limit switch for terminating rotation of said auxiliary rope drum after said auxiliary rope drum has achieved a preselected degree of angular rotation.

7. Apparatus for supporting and controlling an openable-closable grabbing device of hoisting gear which includes a load winch drum, said apparatus comprising:

an extensible, retractible load rope anchoring device;

first and second supports for the openable-closable grabbing device;

a first load rope wrapped at one end around the load winch drum, and being rigged, then around said first support for the openable-closable grabbing device, and at the opposite end thereof to said extensible-retractible anchoring device;

a second load rope wrapped at one end around the load winch drum, and being rigged, then around said second support for the openable-closable grabbing device, and to a fixable anchoring device;

means for extending and retracting the extensible-retractible anchoring device by a selected amount for opening and closing the grabbing device, whereby the grabbing device is supported by both the first and second load ropes, and both load ropes are taken up and paid out in a synchronized manner as the load winch drum is operated, and the grabbing device is opened and closed by effectively lengthening and shortening the amount of the first load rope in use relative to the amount of the second load rope in use by operating said means for extending and retracting said extensible-retractible anchoring device;

the first support for the openable-closable grabbing device comprising:

a pulley block having said first load rope entrained thereabout, said pulley block being mounted on said grabbing device;

two pairs of pulleys mounted with respect to said grabbing device where one of the pulleys of each of the pairs of pulleys moves toward and away from the other of the pulleys of each of the pairs of pulleys for opening and closing said grabbing device; and a hauling rope being entrained about one pair of pulleys of said two pairs of pulleys, whereby:

shortening and lengthening of the relative amount of said first load rope in use by operating said means for extending and retracting said extensible-retractible anchoring device, withdraws and advances said pulley block relative to said second support and moves said one of the pulleys of each of said two pairs of pulleys toward and away from the other of the pulleys of each of the two pairs of pulleys, thus opening and closing the grabbing device.

8. The apparatus of claim 7, wherein:

the first load rope is provided with a first disconnectible connector between load winch drum and a first one pair of pulleys of said two pair of pulleys and with a second disconnectible connector between another second one pair of pulleys of said two pair of pulleys and load winch drum, whereby that portion of the first load rope which extends between the first and second disconnectible connectors constitutes a replaceable hauling rope.

9. The apparatus of claim 7, wherein:

the extensible-retractible rope anchoring device being constituted by an auxiliary rope drum about which the opposite end of said first load rope is wrapped.

10. The apparatus of claim 7, wherein:

the extensible-retractible load rope anchoring device is constituted by a hydraulic cylinder and piston set having an anchored end, and an extensible-retractible end to which said opposite end of the first load rope is secured.

* * * * *